US005507490A

United States Patent [19]

Hagiwara

[11] Patent Number: 5,507,490

[45] Date of Patent: Apr. 16, 1996

[54] GAME APPARATUS

[75] Inventor: Takashi Hagiwara, Setagaya, Japan

[73] Assignee: Sigma Incorporated, Tokyo, Japan

[21] Appl. No.: 518,543

[22] Filed: Aug. 23, 1995

[30] Foreign Application Priority Data

Aug. 26, 1994 [JP] Japan ..... 6-202087

[51] Int. Cl.[6] ..... A63F 7/02

[52] U.S. Cl. ..... 273/138 A

[58] Field of Search ..... 273/459, 460, 273/138 R, 138 A

[56] References Cited

U.S. PATENT DOCUMENTS

| | | | |
|---|---|---|---|
| 4,662,636 | 5/1987 | Crompton | 273/138 A |
| 5,275,402 | 1/1994 | Malavazos et al. | 273/138 A |
| 5,297,816 | 3/1994 | Becchio | 273/459 |

FOREIGN PATENT DOCUMENTS

| | | | |
|---|---|---|---|
| 2114452 | 8/1983 | United Kingdom | 273/139 R |
| 2124913 | 2/1984 | United Kingdom . | |
| 2144643 | 3/1985 | United Kingdom | 273/138 R |
| 2226766 | 7/1990 | United Kingdom . | |

*Primary Examiner*—Paul E. Shapiro
*Attorney, Agent, or Firm*—Hickman Beyer & Weaver

[57] ABSTRACT

An object of the present invention is to provide a highly entertaining game apparatus by introducing unexpectedness to the development of game. The present invention provides a game apparatus characterized in that the apparatus employs a slot (1) for allowing insertion of a medal (12) therethrough, a guide member (5, 14) for guiding the inserted medal (12) downward, a plate (6) arranged substantially horizontally below the guide member (5, 14), a fall-in groove, provided at at least one end of the plate (6), for discharging the medal (12) to an outside, a slidable member (8) which moves reciprocally on the plate (6) in a predetermined direction, and a medal (12) which falls through the guide member (5, 14) while the slidable member (8) moves, thereby causing the medals (12) on the plate (6) to fall into the fall-in groove, and characterized by including scattering mechanism (10) for scattering the medals (12) on the plate (6).

18 Claims, 14 Drawing Sheets

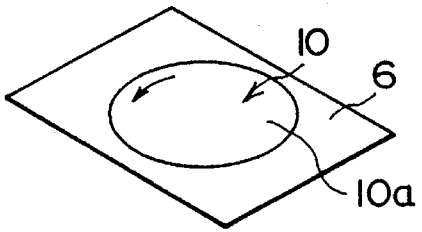
Fig. 8A
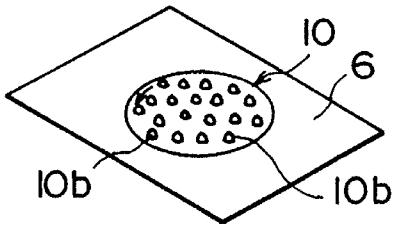
Fig. 8B
Fig. 8C
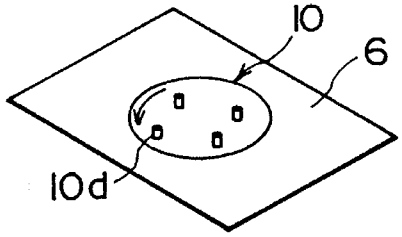
Fig. 8D
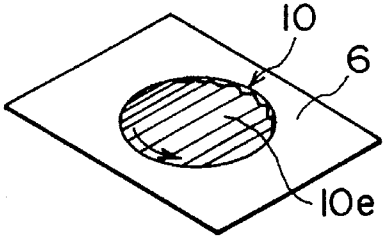
Fig. 8E
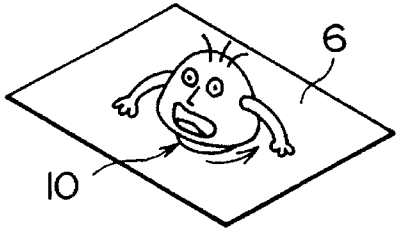
Fig. 8F
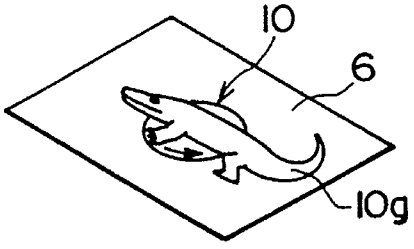
Fig. 8G
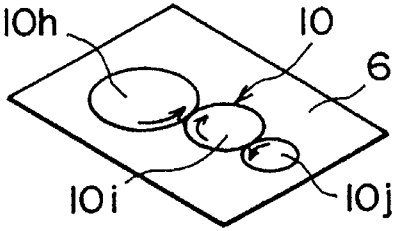
Fig. 8H
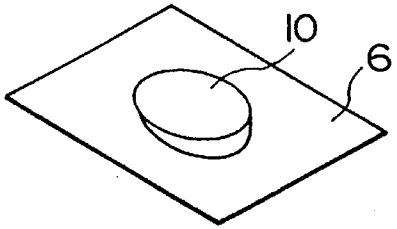
Fig. 8I

GAME APPARATUS

BACKGROUND OF THE INTENTION

1. Field of the Invention

The present invention relates to a so-called pusher game apparatus and, more particularly, to a game apparatus which employs a slot for allowing insertion of a medal therethrough, a guide means for guiding the inserted medal downward, a plate arranged substantially horizontally below the guide means, a fall-in groove, provided at at least one end of the plate, for discharging the medal to an outside, a slidable member which moves reciprocally on the plate in a predetermined direction, e.g., forward and backward or left and right, and a medal which falls through the guide means while the slidable member moves, thereby causing medals on the plate to fall into the fall-in groove. A "medal" broadly means a disk-like member and includes a coin or token. Preferably, a circular plate-like member is employed.

2. Related Background Art

A pusher game is known, in which medals are pushed into a fall-in groove with a pusher slidable on a play field, thereby paying off a number of medals to the player (Japanese Patent Publication No. 5-73438 and Japanese Utility Model Publication Nos. 63-305 and 53-24390).

In a game apparatus of this type, whether or not a player can let medals fall depends on luck. If the player is very unlucky, and medals do not fall at all, the game is not very fun. Therefore, the above pusher game apparatus is designed to pay off special medals such as bonanza medals under predetermined conditions.

Although the conventional pusher game apparatus provides fun as it supplies special medals, it lacks unexpectedness in the development of the game and thus does not provide sufficient entertainment.

SUMMARY OF THE INVENTION

It is, therefore, an object of the present invention to provide a highly entertaining game apparatus in which unexpectedness is introduced in the development of game.

In order to achieve the above object, according to the present invention, there is provided a game apparatus characterized in that the apparatus employs a slot for allowing insertion of a medal therethrough, a guide means for guiding the inserted medal downward, a plate arranged substantially horizontally below the guide means, a fall-in groove, provided at at least one end of the plate, for discharging the medal to an outside, a slidable member which moves reciprocally on he plate in a predetermined direction, and a medal which falls through the guide means while the slidable member moves, thereby causing medals on the plate to fall into the fall-in groove, and comprises scattering means for scattering medals on the plate.

Since the present invention has the above arrangement, a predetermined number of medals are scattered in 360°-directions. As a result, the medals on the plate are disordered. Then, a new game condition and game development are produced.

To start the scattering means is a change that totally innovates the concept of game of being a monotonous reciprocal movement of the pusher. Since special medals are supplied to the player at a nigh possibility, the player is expected to have a will to start the scattering means. As a result, the player is eager to continue the game.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIGS. 7A to 7C include perspective views showing arrangements of circular rotary plates, in which FIGS. 7A and 7B show arrangements of a single-stage deck type apparatus and FIG. 7C shows an arrangement of a double-stage deck type apparatus;

FIGS. 8A to 8I include perspective views showing modifications of the circular rotary plate that can be applied to the present invention;

DESCRIPTION OF THE PREFERRED EMBODIMENTS

Figure 1:
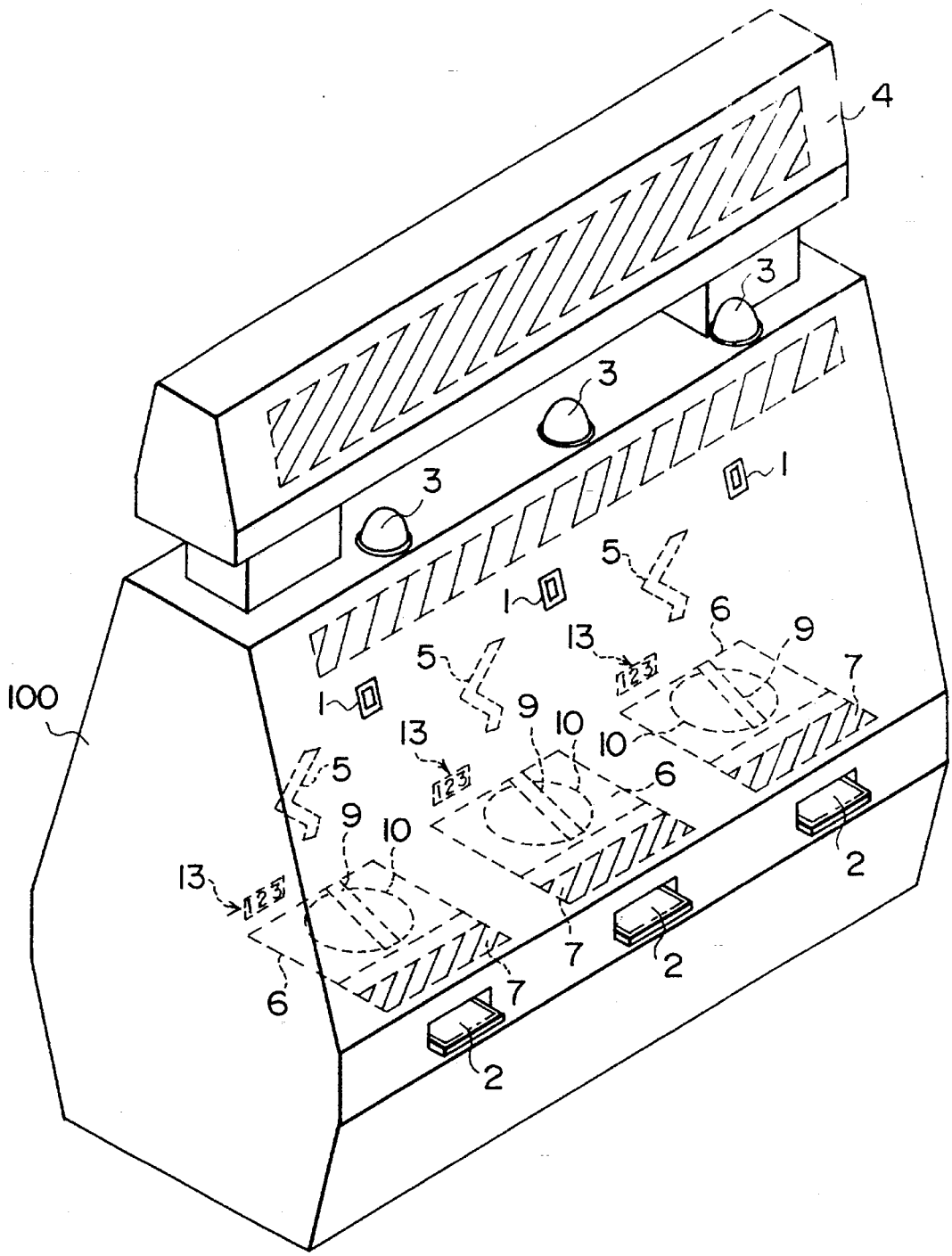
FIG. 1 is a perspective view showing the outer appearance of a pusher game apparatus according to the first embodiment of the present invention.

A game apparatus according to the present invention will be described with reference to the accompanying drawings.

In the description of the drawings, the same reference numerals are used to denote the same elements, and a repetitive description will be omitted.

First, a pusher game apparatus according to an embodiment of the present invention will be described with reference to FIGS. 1 to 5.

Figure 2:
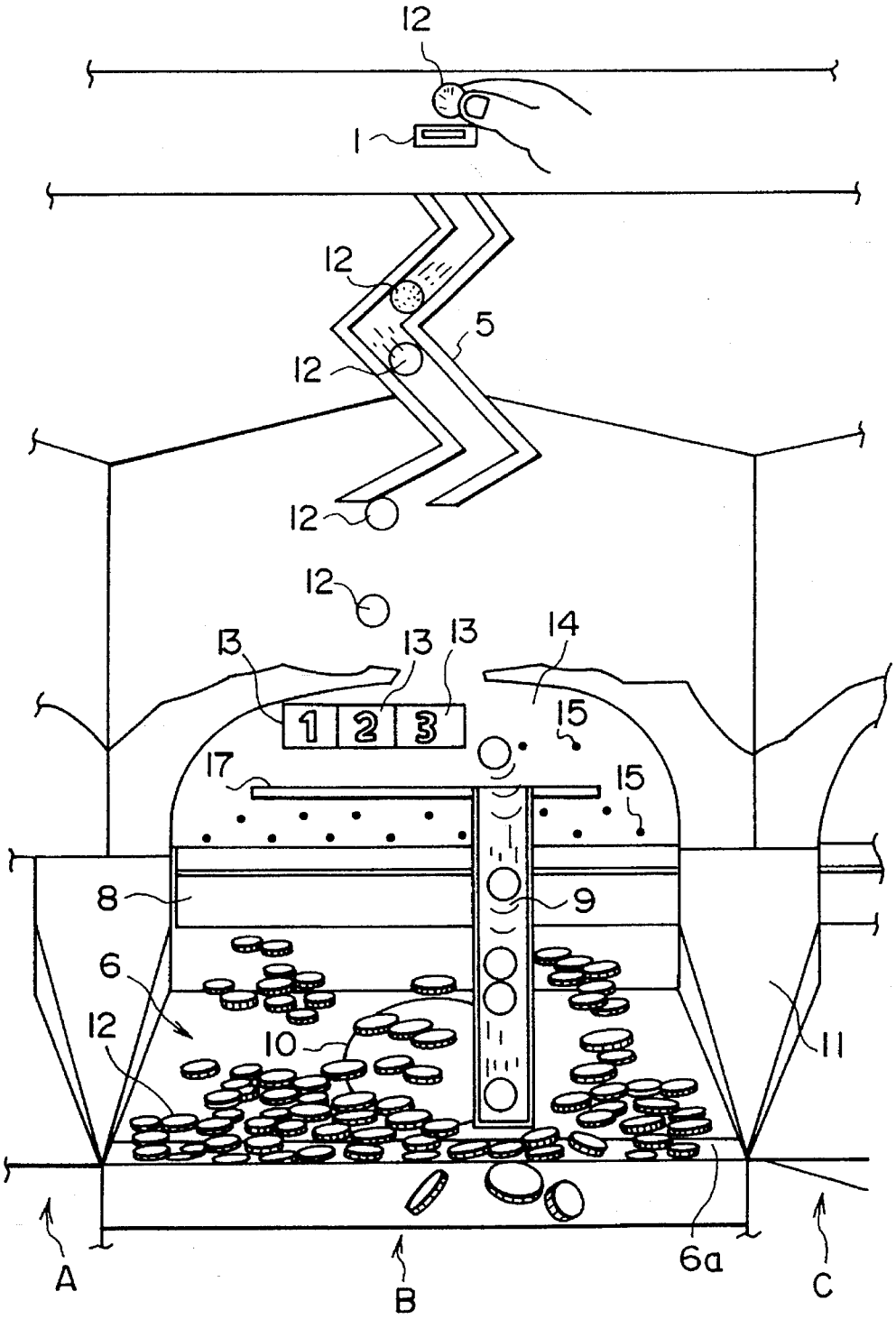
FIG. 2 is a front view showing the main part of the pusher game apparatus according to the first embodiment.
Figure 3:
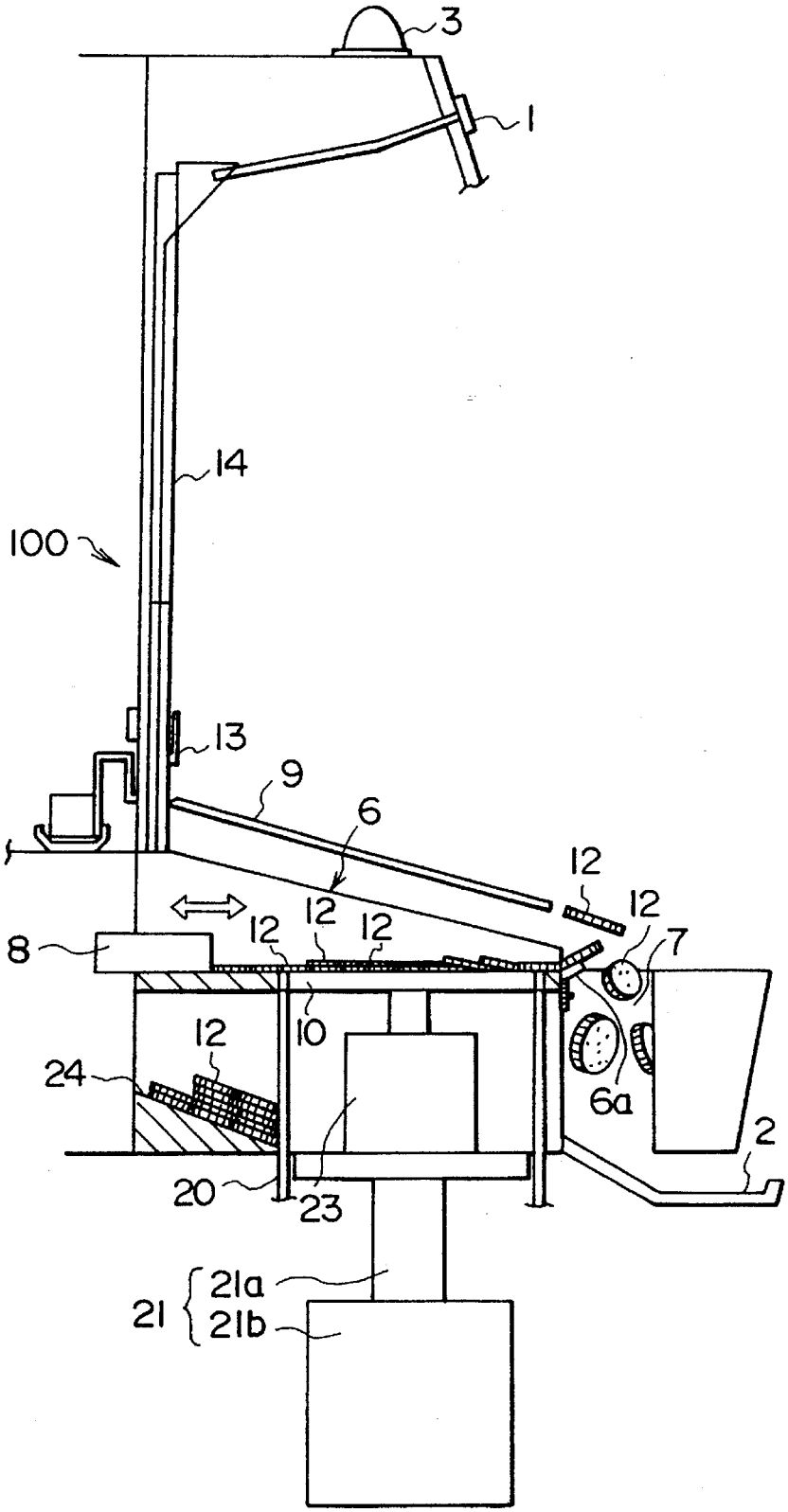
FIG. 3 is a side view showing the main part of the pusher game apparatus according to the first embodiment.
Figure 4A:
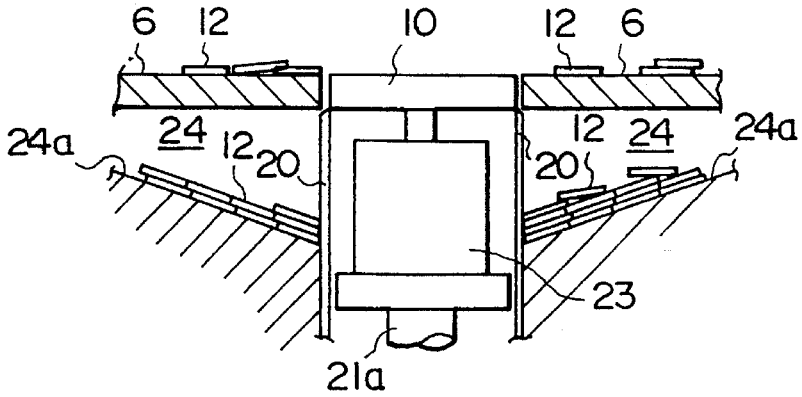
FIGS. 4A to 4D include longitudinally sectional views showing an example of a medal replenishing mechanism that can be used in the pusher game apparatus according to the first embodiment.
Figure 4B:
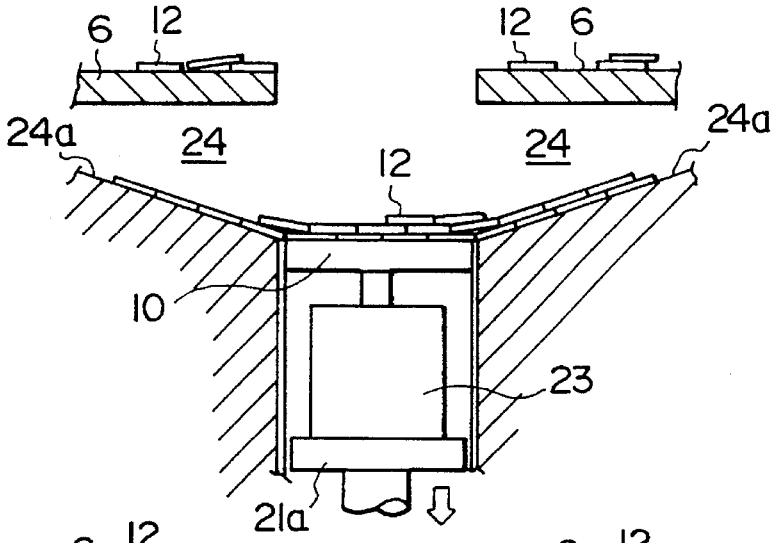

FIG. 1 is a perspective view showing the outer appearance of the pusher game apparatus according to this embodiment. FIG. 2 is a front view showing the main part of the pusher game apparatus according to this embodiment. FIG. 3 is a side view showing the main part of the pusher game apparatus according to this embodiment. FIGS. 4A to 4D are longitudinally sectional views showing an example of a medal replenishing mechanism that can be used in the pusher game apparatus according to this embodiment. FIG. 5 is a block diagram snowing the major arrangement of the pusher game apparatus according to this embodiment.

This game apparatus has medal slots 1 mounted on the outer portion of a main body 100, medal payoff ports 2, jackpot informing lamps 3, and an indicator 4. Guide paths 5 constituting part of guide means, plates 6, fall-in grooves 7, slidable members 8 (see FIG. 2), medal guides 9, circular rotary plates 10 constituting part of scattering means, and an informing voice loudspeaker are included in the interior of the game apparatus.

First, the contents of the game will be briefly described in order to facilitate understanding of the present invention. This game is so-called a "pusher game" in which the player has a chance to get a large number of medals with a small number of medals. The charm of this game exists in a variety of developments of the game. Medals 12 are inserted through each medal slot 1 and guided to the corresponding plate (deck) 6 forming a play field. A slidable member 8 exists on the plate 6 to slide on its surface at a predetermined interval in a predetermined direction. Some of the medals 12 reaching the plate 6 are pushed toward a terminal end portion **6*a* of the plate 6 by the operation of the slidable member 8. A fall-in groove 7 is present at the terminal end portion 6*a* of the plate 6, and the medals 12 that fall into the fall-in groove 7 are returned to the player. A guide portion 14 having a plurality of pins 15 and jackpot portions 13 which induce the function of a jackpot is arranged along a path extending from the medal slot 1 to the plate 6. A guide groove 17 along which the medal guide 9 is slid is horizontally formed below the guide portion 14. A medal introducing portion for accepting the medals 12 is formed on a side of the guide groove 17 of the medal guide 9. A medal 12 entering through the medal introducing portion is straightly guided to the terminal end portion 6*a* of the plate 6, as shown in FIG. 2, and collides with medals 12 clustering together at the terminal end portion 6*a* of the plate 6. As a result, some medals 12 fall from the fall-in groove 7**. A jackpot is a state in which a predetermined number of medals are supplied to the player, or which forms a factor that causes this supply, regardless of an expression form (e.g., bonanza or bonus). In the present invention, jackpot includes, e.g., to generate a medal scattering start signal which is provided to start the scattering means.

Therefore, the player must insert the medal 12 into the medal slot 1 at a good timing so that the medal 12 will smoothly go onto the medal guide 9. The skill of the player for this causes a difference in number of obtained medals 12.

Three game fields A, B, and C are formed in the main body 100 through partition members 11, and each game field has the guide path 5, the plate 6, the fall-in groove 7, the slidable member 8, and the circular rotary plate 10. The medal 12 inserted through the medal slot 1 is guided downward through the guide path 5, as described above. The plate 6 is arranged below the guide path 5, and the three jackpot portions (No. 1, No. 2, and No. 3) 13 and the medal guide 9 are arranged midway along the guide path 5. The respective jackpot portions 13 have different functions, e.g., a function of rotating the left circular rotary plate 10 through one revolution (or for 1 sec.), a function of rotating the central circular rotary plate 10 through two revolutions (or for 2 sec.), and a function of rotating the right circular rotary plate 10 through three revolutions (or for 3 sec.) These jackpot portions 13 are arranged in the guide portion 14 provided upright below the guide path 5. The large number of pins 15 are arranged at appropriate gaps in the remaining region of the guide portion 14. The medal 12 discharged from the guide path 5 is moved downward by the gravity, enters the guide portion 14, and is moved downward as it is guided by the pins 15. The groove 17 for sliding the medal guide 9 is formed elongatedly in the horizontal direction below the guide portion 14. The medal guide 9 is moved horizontally along the guide groove 17. It is thus preferable that the player insert the medal 12 through the medal slot 1 while paying attention to the movement of the medal guide 9. Once the medal 12 is inserted in the medal guide 9, it is guided by the medal guide 9 and dropped in the vicinity of the terminal end portion **6*a* of the plate 6. As a result, when this fallen medal 12 collides with the medals 12 that are pushed toward the terminal end portion of the plate 6, some medals 12 fall in the fall-in groove 7 and are returned to the player (see FIG. 3**).

The pusher game apparatus according to this embodiment has a medal scattering mechanism and the first medal replenishing mechanism.

The medal scattering mechanism operates when, e.g., the medal 12 enters any one of the jackpot portions 13. When or while the medal scattering mechanism operates, the informing lamp 3 flashes and/or informing voice is produced from the loudspeaker. When there are a plurality of jackpot portions 13, the type of each jackpot portion 13 is detected by a jackpot type detection unit 35 based on a signal sent from a sensor 34. Information concerning the detected jackpot is sent to a control means 30. Based on this type detection signal, the control means 30 determines the number of revolutions (or rotation time) of the circular rotary plate 10. The control means 30 supplies a scattering instruction to a medal scattering mechanism driving unit 33, thereby driving a motor 23. As a result, the medals 12 on the circular rotary plate 10 are scattered on the surrounding plate 6. The basic arrangement of the medal scattering mechanism is achieved by the circular rotary plate 10 and the motor 23, as described above.

The first medal replenishing mechanism has a function of replenishing medals 12 onto the circular rotary plate 10 after scattering medals 12 on the plate 6. For this purpose, the medal replenishing mechanism is constituted by a cylindrical partition member 20, a first elevating mechanism 21, a second elevating mechanism 22, and a medal accumulating portion 24. The medal accumulating portion 24 which is inclined to form an inverted cone is arranged around the first elevating mechanism 21 through the cylindrical partition member 20. A predetermined number of medals are accumulated in the medal accumulating portion 24 such that they in on the cylindrical partition member 20.

The mechanical arrangement and electrical arrangement of the above components will be described with reference to FIGS. 4A to 4D and 5.

The circular rotary plate 10 is buried in the plate 6 such that the upper surfaces of the plate 6 and circular rotary plate 10 constitute almost the same surface. The circular rotary plate 10 is arranged within the plate 6 through a small gap that allows smooth rotation of the circular rotary plate 10 and thus allows smooth movement of the medals 12. The motor 23 has a rotation shaft which is connected to the plate 6 and is perpendicular to the flat surface of the plate 6. Thus, the circular rotary plate 10 is rotatable along the flat surface of the plate 6. The motor 23 is mounted to the first elevating mechanism 21, and the first elevating mechanism 21 can vertically move a movable portion 21a below the plate 6 in a direction perpendicular to the upper surface of the plate 6. The second elevating mechanism 22 is constituted by, e.g., a rack-and-pinion mechanism, and can vertically move the cylindrical partition member 20 in a direction perpendicular to the upper surface of the plate 6.

The electrical arrangement will be described. This system is basically constituted by the control means 30, a first elevating mechanism driving unit 31, a second elevating mechanism driving unit 32, the medal scattering mechanism driving unit 33, the sensor 34, and the jackpot type detection unit 35. When a medal 12 enters a jackpot portion 13, a detection signal is generated by the corresponding sensor 34. This detection signal is sent to the jackpot type detection unit 35, and a type detection signal is sent to the control means 30. Based on this type detection signal, the control means 30 sends the first, second, and third control signals to the second elevating mechanism driving unit 32, the first elevating mechanism driving unit 31, and the medal scattering mechanism driving unit 33, respectively. Based on these signals, the second elevating mechanism 22, the first elevating mechanism 21, and the medal scattering mechanism (the motor 23 and the circular rotary plate 10) are controlled by the corresponding driving units.

The operation of the scattering mechanism and the first medal replenishing mechanism will be described in detail. FIG. 4A shows a state immediately after the circular rotary plate 10 has operated. No medal 12 exists on the upper surface of the circular rotary plate 10. Hence, the medal replenishing mechanism is operated to replenish medals. The procedures for this are as follows. First, the control means 30 supplies the third control signal to the medal scattering mechanism driving unit 33, and thereafter supplies the first and second control signals to the first and second elevating mechanism driving units 31 and 32, respectively. As a result, the first and second elevating mechanisms 21 and 22 are moved downward to a level where the upper surface of the circular rotary plate 10 coincides with an inclined surface 24*a* of the medal accumulating portion 24. Since the stored medals 12 are accumulated as they are piled and lean on the cylindrical partition member 20, when the circular rotary plate 10 coincides with the inclined surface 24*a*, some of the medals 12 stored in the medal accumulating portion 24 fall in onto the circular rotary plate 10 (FIG. 4B). As a result, the medals 12 are replenished on the upper surface of the circular rotary plate 10.

Figure 4C:
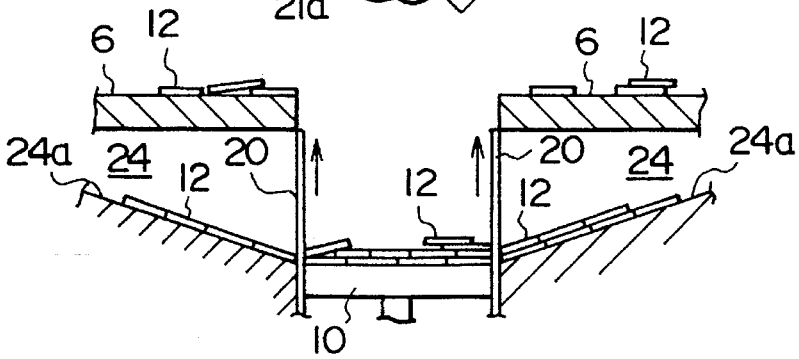
Figure 4D:
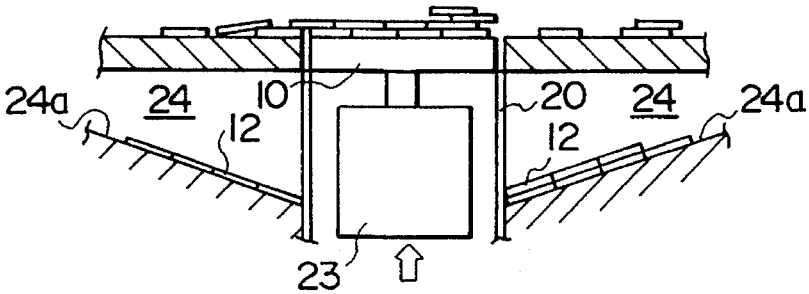
Figure 5:
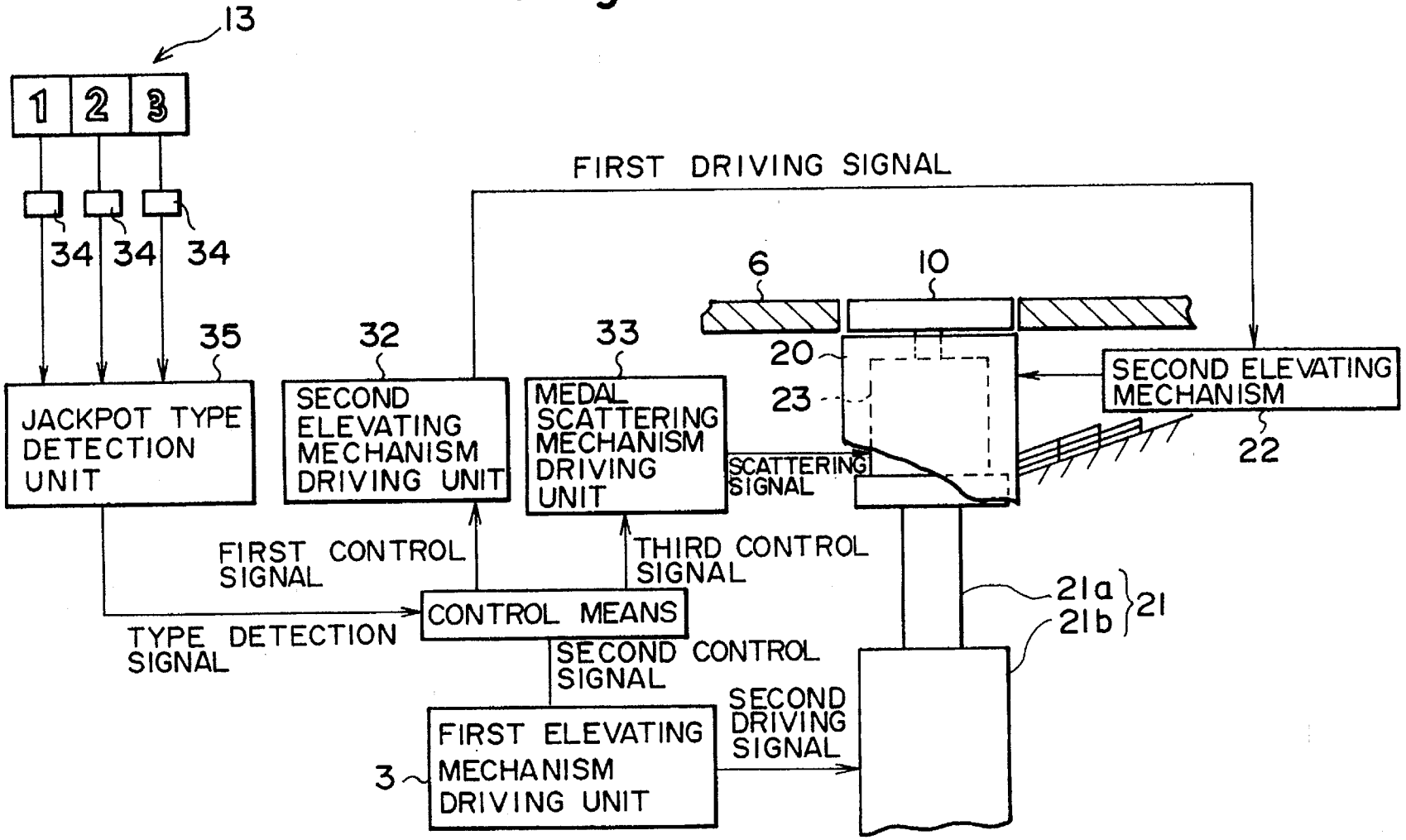
FIG. 5 is a block diagram showing the main arrangement of the pusher game apparatus according to the first embodiment.

Then, the control means 30 supplies the second control signal to the second elevating mechanism driving unit 32 to move the cylindrical partition member 20 upward earlier than the circular rotary plate 10 (FIG. 4C). By this operation, a wall which holds the medals 12 falling onto the upper surface of the circular rotary plate 10 is formed, so that the medals 12 are prevented from dropping from the circular rotary plate 10. Thereafter, the control means 30 supplies the first control signal to the first elevating mechanism driving unit 31 to move the first elevating mechanism 21, thereby restoring the circular rotary plate 10 on which the medals 12 are replenished to the original position (FIG. 4D).

Since the pusher game apparatus according to this embodiment has the medal scattering mechanism and the medal replenishing mechanism in this manner, the development of the game is totally changed to an interesting one, thereby further improving the entertainment.

Figure 6:
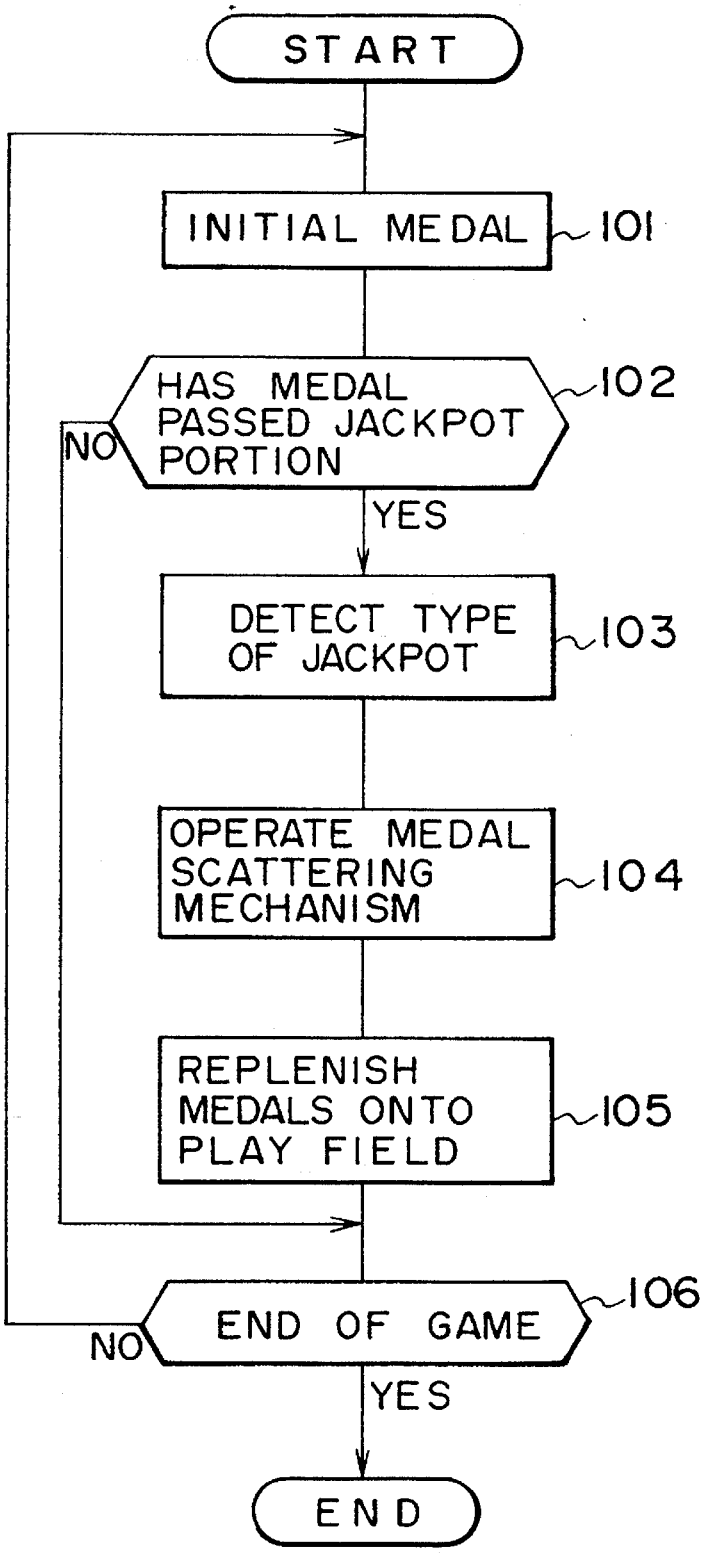
FIG. 6 is a flow chart showing how to play the pusher game apparatus according no the first embodiment.

How to play the pusher game apparatus according to this embodiment will be described with reference to FIG. 6. FIG. 6 shows the flow chart indicating how to play the pusher game apparatus. First, a medal 12 is inserted in the medal slot 1. Since the medal guide 9 moves reciprocally above The plate 6 an a predetermined time interval, as described above, the player usually inserts the medal 12 at an appropriate timing (step 101).

Although the medal 12 is guided onto the plate 6 through the guide portion 14, it may enter a jackpot portion 13 on the midway. Therefore, whether the medal 12 has passed any jackpot portion 13 is determined (step 102) If the medal 12 has passed a jackpot portion 13, the type of the jackpot portion 13 is detected (step 103). This type detection is performed by the sensor 34 and the jackpot type detection unit 35, as described above. When a type detection signal that can specify the type of the jackpot portion 13 is sent from the jackpot type detection unit 35 to the control means 30, the control means 30 supplies the third control signal to the medal scattering mechanism driving unit 33, and the medal scattering mechanism driving unit 33 supplies a scattering signal to the motor 23. As a result, the motor 23 is rotated to scatter the medals 12 on the upper surface of the circular rotary plate 10 (step 104). Thereafter, the circular rotary plate 10 is moved downward by the operation of the first elevating mechanism 21. After a large number of medals 12 are placed on the circular rotary plate 10, the circular rotary plate 10 is returned to the play field. The medals 12 are replenished on the play field described above by this operation (step 105). When the player wishes to play the game successively, he inserts a medal 12 again in the medal slot 1 (step 101). In place of actually paying the medal 12, the player can play the game by accumulating payoff medals in the form of credits.

Figures 7A, 7B, 7C:
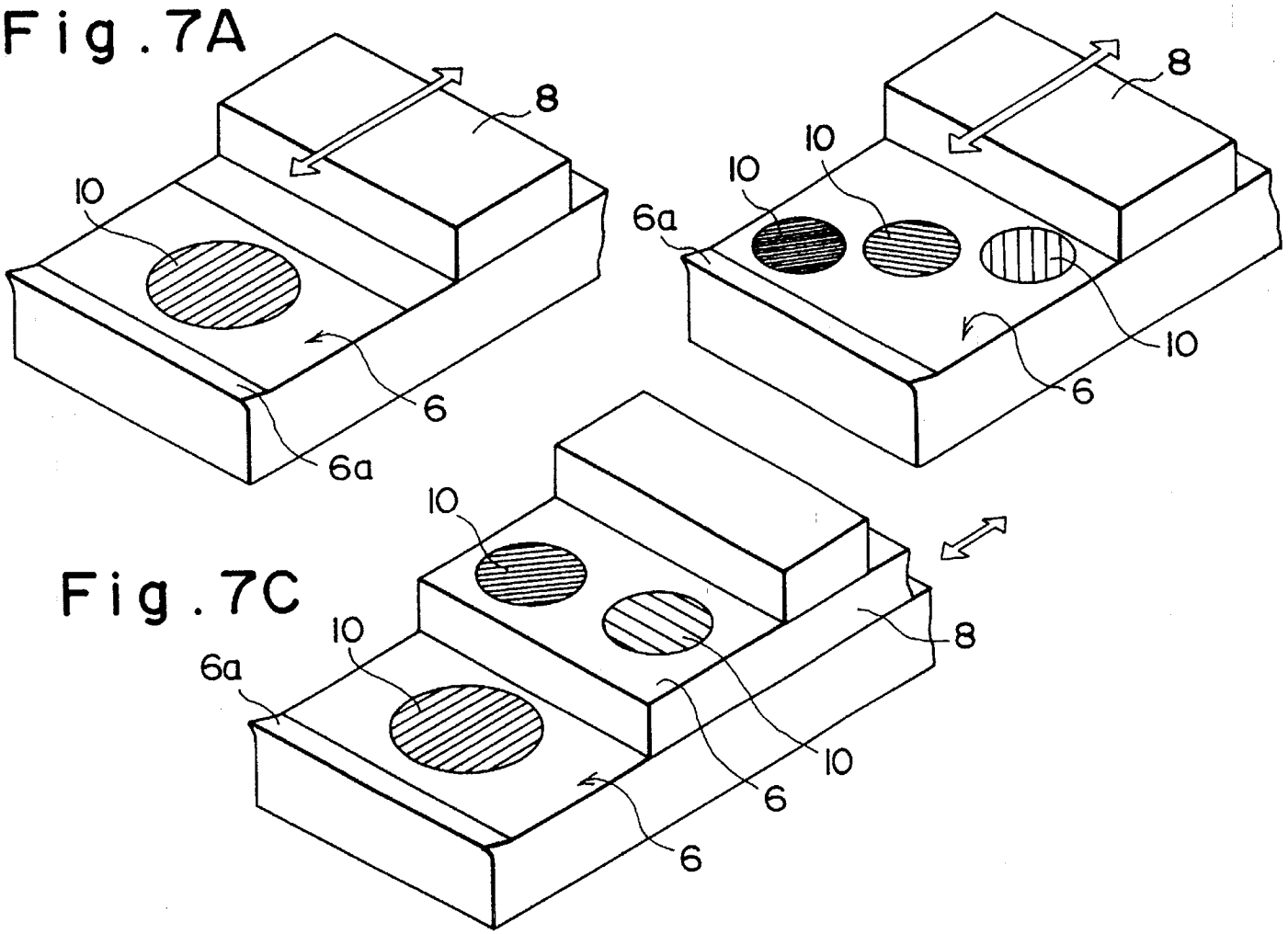

Arrangements of circular rotary plates that can be used in the present invention will be described with reference to FIGS. 7A to 7C. FIGS. 7A to 7C include perspective views showing these arrangements. FIG. 7A shows a case in which a single circular rotary plate 10 is buried in a single-step deck type plate 6. As a mechanism for rotating the circular rotary plate 10, the structure described above can be used. The upper surface of this circular rotary plate 10 forms corrugations at a predetermined pitch interval so that hills and bottoms appear at a predetermined interval. FIG. 7B shows a case in which three circular rotary plates 10 are buried in a single-stage deck type plate 6. For example, the upper surfaces of the respective circular rotary plates 10 form corrugations at different pitch intervals. More specifically, the upper surface of the left circular rotary plate 10 forms corrugations most densely. The upper surface of the right circular rotary plate 10 forms corrugations most sparsely. The upper surface of the circular rotary plate 10 at the center forms corrugations at an intermediate interval between those of these two circular rotary plates 10. The circular rotary plates 10 have the arrangements as described above and can be driven independently. FIG. 7C shows the arrangement of double-stage deck type plates 6. The upper surface of a slidable member 8 forms an upper-stage plate 6, and a fixing member is arranged at the end portion of the upper-stage plate 6. Two circular rotary plate 10 are buried in the upper-stage plate 6, and one circular rotary plate 10 is buried in a lower-stage plate 6. A medal 12 is guided to a guide portion 14 and falls onto, e.g., the upper-stage plate 6. Since the slidable member 8 is moved reciprocally in the horizontal direction, the medal 12 on the upper-stage plate 6 is pushed by the fixing member toward the terminal end portion of the upper-stage plate 6 and to the lower-stage plate 6 afterwards. Since the slidable member 8 is reciprocally moved on the upper surface of the lower-stage plate 6, the medal 12 on the lower-stage plate 6 is directly pushed by the slidable member 8 toward a terminal end portion 6*a* of the lower-stage plate 6.

In FIGS. 7B and 7C, the three circular rotary plate 10 are assigned to three jackpot portions 13. For example, when the medal 12 enters a No. 1 jackpot portion 13, the upper-stage left circular rotary plate 10 may be driven in FIG. 7C. When the medal 12 enters a No. 2 jackpot portion 13, the upper-stage right circular rotary plate 10 may be driven. When the medal 12 enters a No. 3 jackpot portion 13, the lower-stage circular rotary plate 10 may be driven. Alternatively, when a medal 12 enters a specific jackpot portion, all the circular rotary plates 10 may be rotated at once. These detailed setting conditions can be arbitrarily determined in accordance with the game conditions. A specific scattering means which will be operated, or/and a specific operation time (or the number of revolutions) thereof may be determined by a random number generating unit incorporated in the control unit. If an indicator for indicating to the player a specific scattering unit which will operated and its specific operation time (the number of revolutions or time) is provided, and constantly gives indication and information to the player, a larger effect can be obtained.

Modifications of the circular rotary plate will be described with reference to FIGS. 8A to 8I. FIGS. 8A to 8I include perspective views showing modifications of a circular rotary plate that can be applied to the present invention. FIG. 8A shows a case wherein a cover 10*a* having a high coefficient of friction is adhered to the upper surface of a circular rotary plate 10. An example of the material of the cover 10*a* includes rubber, cloth, and a resin member. FIG. 8B shows a case wherein a large number of small conical projections 10*b* are formed on the upper surface of a circular rotary plate to increase she substantial coefficient of friction of the surface of the circular rotary plate. Although medals are pushed by a slidable member 8 and are moved over these projections, they tend to stay on the circular rotary plate 10. FIG. 8C shows a case wherein a large number of grooves 10*c* are formed in the upper surface of a circular rotary plate. Since the interval of the grooves 10*c* is determined not to cause a medal to fall in the grooves 10*c*, the medal 12 will not fall in the grooves 10*c* and be interfered with from moving. FIG. 8D shows a case wherein a plurality of pins 10*d* are provided upright on the upper surface of a circular rotary plate 10 at gaps at least equal to the diameter of the medal. Hence, a medal 12 will not be caught by the pins 10*d* while it is pushed by a slidable member 8 toward a terminal end portion 6*a* of a plate 6. FIG. 8E shows a circular rotary plate 10 whose upper surface forms corrugations 10*e* at an irregular pitch. The pitch interval is small near the two ends of the circular rotary plate 10 in a predetermined direction, and is large near the central direction of the circular rotary plate 10. When the circular rotary plate 10 is formed in this manner, it can change the moving state of the medal 12. FIG. 8F shows a case wherein a doll 10*f* made of a hard material is arranged on the upper surface of a circular rotary plate 10. Two arms extending to a plate 6 are attached to the doll 10*f*, so that medals 12 can be scattered by these arms as well. A doll 10*f* may be mounted with a thin shaft, so that the medals 12 may be scattered only by the arms of the doll 10*f*. In this case, a doll having a large mounting area can be mounted without interfering the medals 12 from moving. FIG. 8G shows a case wherein a doll 10*g* made of a soft material is arranged on the upper portion of a circular rotary plate 10. In this case, medals 12 on a plate 6 are scattered by utilizing the elasticity of the doll 10*g*. In the circular rotary plate using this doll, the doll may be provided with effects (e.g., a sound effect, a visual effect, and an olfactory effect) which stimulate the five senses of the player, thereby appealing to the player that a medal has entered a jackpot portion. For example, the doll's eyes may be flashed in red, the doll may produce a large sound or voice, or the doll may spray a perfume while a medal enters a jackpot portion and thus the circular rotary plate 10 is rotated. In FIG. 8H, a plurality of circular rotary plates 10*h*, 10*i*, and 10*j* are circumscribed with each other, and are moved in an interlocked manner by frictional contact with each other. Thus, in this case, e.g., only the circular rotary plate 10*j* is connected to a motor 23. When the motor 23 is driven, the circular rotary plates 10*j*, 10*i*, and 10*h* are rotated counterclockwise, clockwise, and counterclockwise, respectively. Hence, the medals 12 can be scattered efficiently over a wide area by a single driving source. Circular rotary plates whose upper surfaces are leveled with plates 6 have been described. However, the circular rotary plate and the plate 6 need not be of the same height. FIG. 8I shows such an example in which a cylindrical member is cut obliquely. In this case, a circular rotary plate serves as an obstacle when medals are pushed by a slidable member 8. However, when the circular rotary plate 10 is rotated, the medals are scattered from a high place by the centrifugal force, so that they are scattered farther. Thus, the medals can be scattered in a wider area.

A second medal replenishing mechanism that can be applied to the present invention will be described with reference to FIGS. 9A and 9B.

Figure 9A:
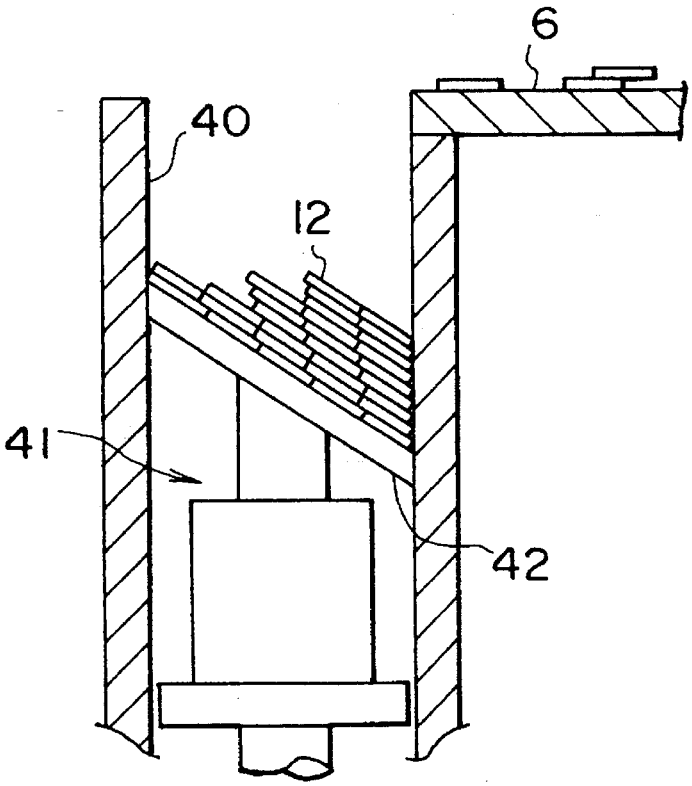
FIGS. 9A and 9B include process views showing the operation of the second medal replenishing mechanism that can be applied to the present invention.
Figure 9B:
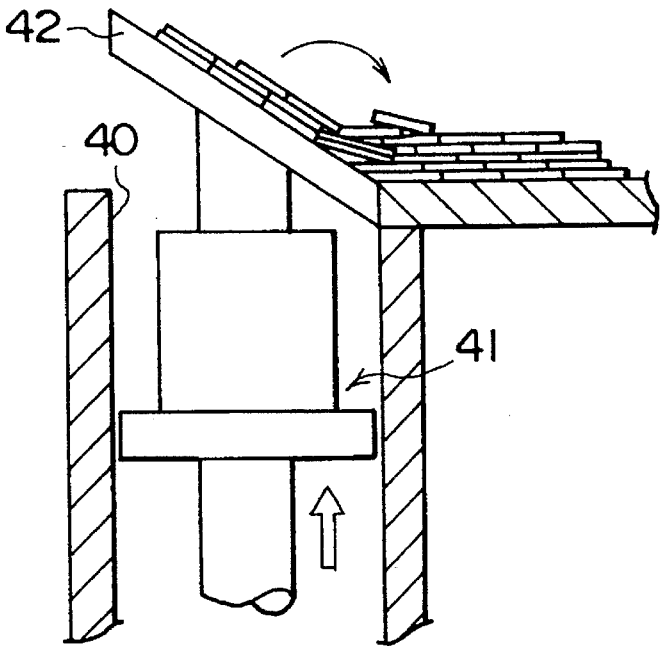

FIGS. 9A and 9B include process views showing the operation of the second medal replenishing mechanism.

This medal replenishing mechanism is different from the first medal replenishing mechanism (see FIGS. 4A to 4D) in that it replenishes medals 12 not onto a circular rotary plate 10 but onto a plate 6. This medal replenishing mechanism is constituted by a pocket 40 formed inside or around the plate 6, an elevating mechanism 41 arranged in the pocket 40, and an inclined plate 42, provided to the elevating mechanism 41, for returning medals 12 fell in the pocket 40 onto the plate 6. The elevating mechanism 41 can be constituted by a known mechanism including, e.g., a motor, a pulley, and a belt, or a known mechanism using a solenoid. The mechanism including the motor, pulley, and belt is effective when returning the medals over a long period of time. The mechanism using the solenoid is effective when returning the medals in a discharging manner at once. The inclined plate 42 has such an angle of inclination that the medals 12 on it naturally slide to the plate 6 side. When the inclined plate 42 is lifted, its lower end portion coincides with the height of the plate 6. The practical angle of inclination is determined by the weight of the medals, the material of the medals, the material of the inclined plate, and the like.

FIG. 9A is a longitudinally sectional view showing a state before medals 12 are replenished. FIG. 9B is a longitudinally sectional view showing a state wherein the inclined plate 42 is lifted and the medals 12 are being replenished onto the plate 6.

As the inclined plate 42 has been moved downward in the pocket 40 at first (see FIG. 9A), the pocket 40 serves as a pitfall for the medals 12. The medals 12 fall in the pocket 40 during the gamer and a predetermined number of medals 12 are accumulated in the pocket 40. The accumulated medals 12 are stored as they lean on the side wall (see FIG. 9A).

After a predetermined number of medals 12 are accumulated, the inclined plate 42 is lifted by the elevating mechanism 41. When the lower end portion of the inclined plate 42 coincides with the plate 6, the elevating mechanism 41 is stopped. In this state, the medals 12 are supplied onto the plate 6 (see FIG. 9B).

Figure 10:
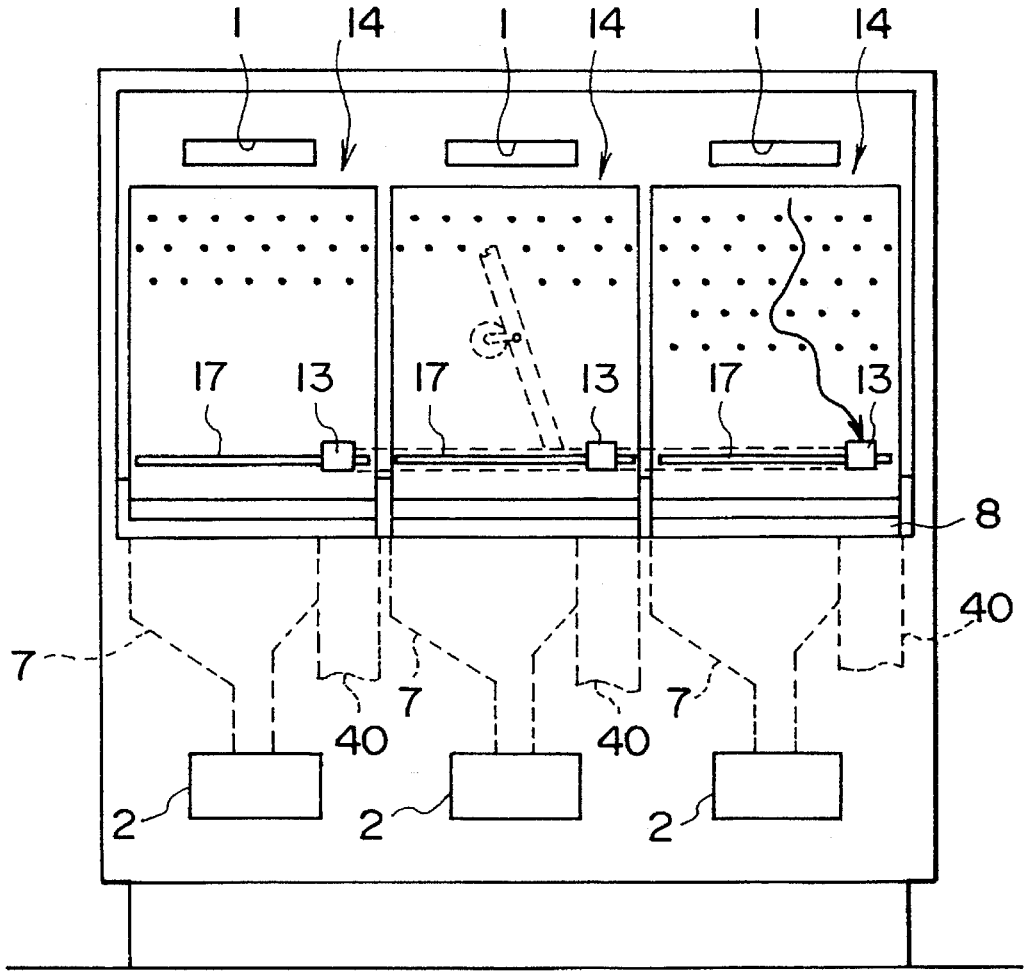
FIG. 10 is a front view of a pusher game apparatus according to the second embodiment of the present invention which is seen from the front side.
Figure 11:
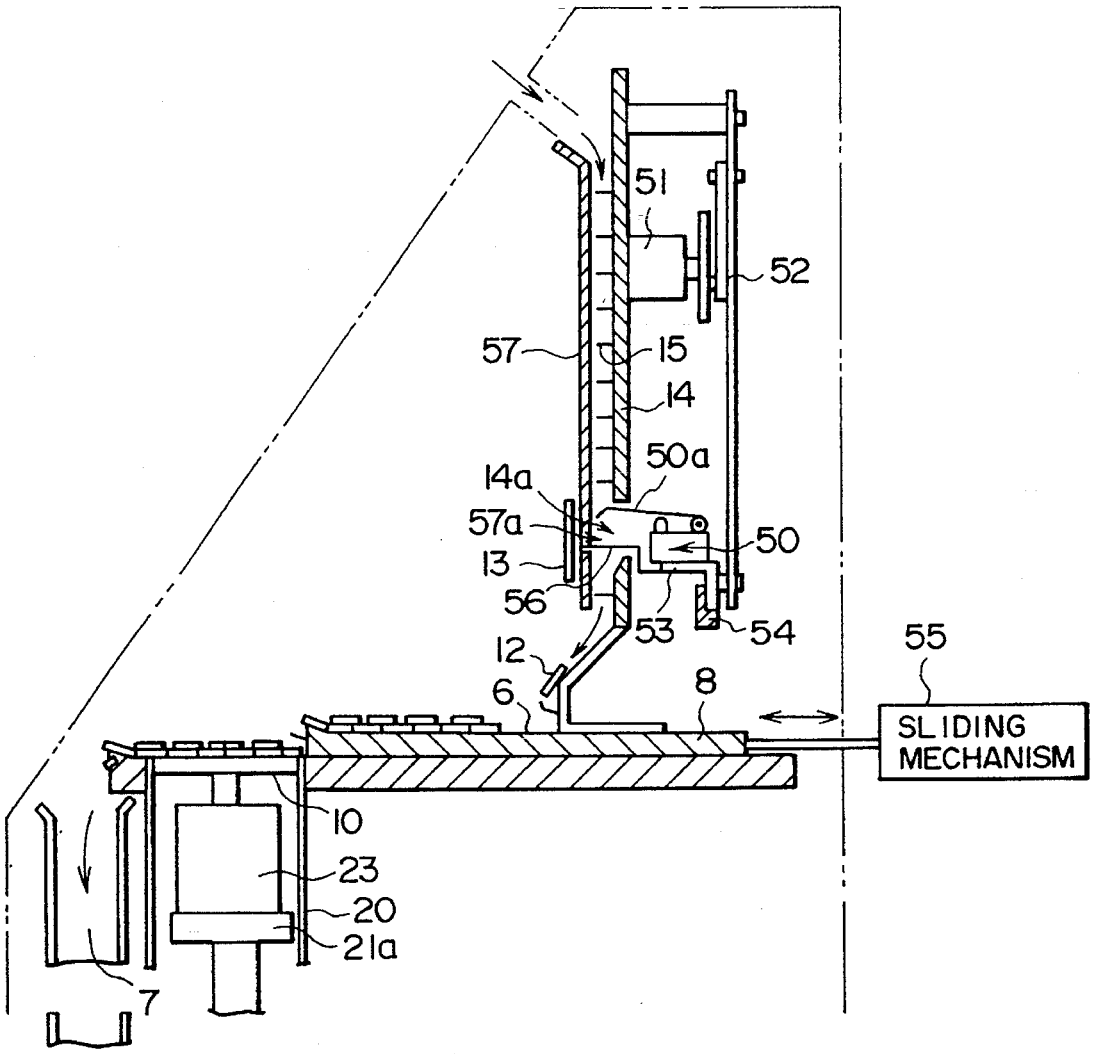
FIG. 11 is a longitudinally sectional view showing the apparatus according to the second embodiment taken along a plane perpendicular to a guide plate and a plate according to the second embodiment.
Figure 12:
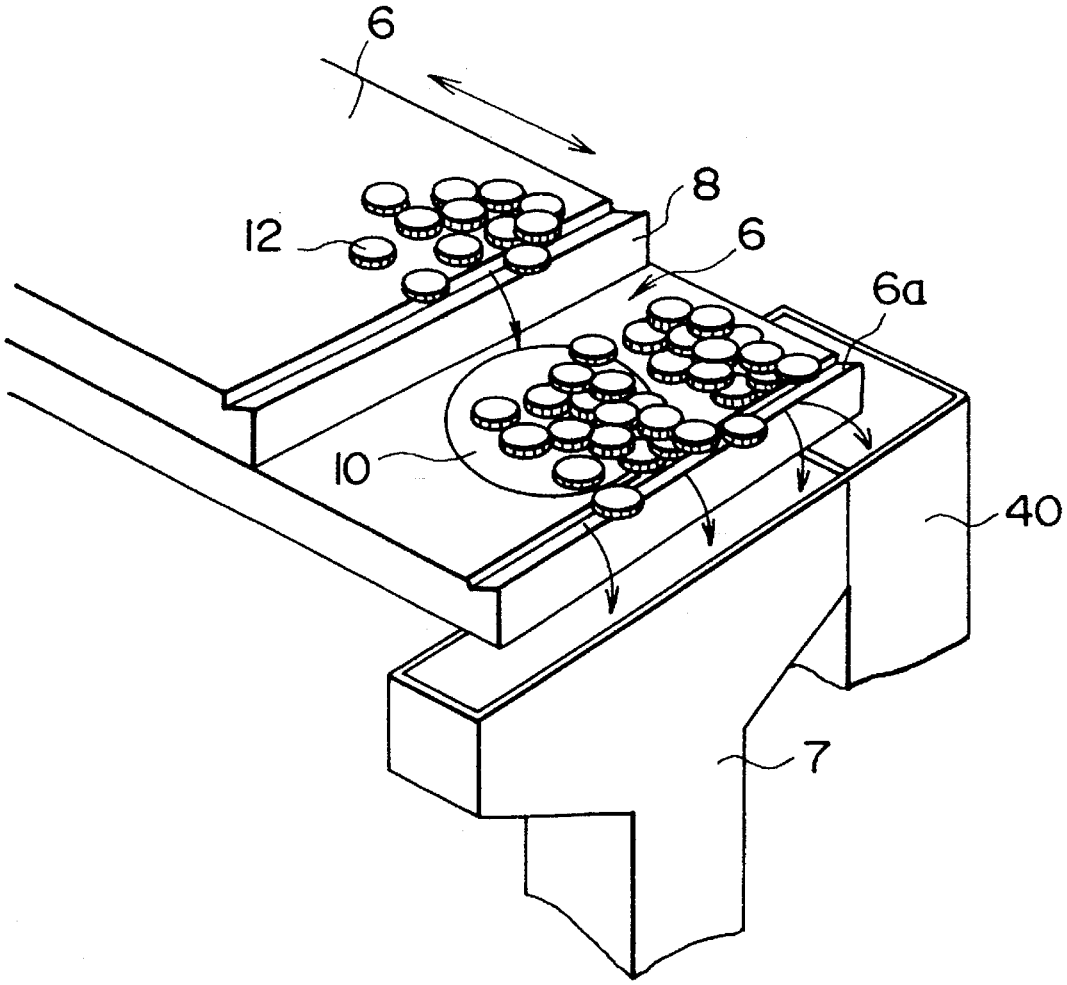
FIG. 12 is a perspective view showing a fall-in groove and a plate of the apparatus according to the second embodiment.

A pusher game apparatus according to the second embodiment of the present invention will be described with reference to FIGS. 10 to 12. FIG. 10 is a front view of the pusher game apparatus according to the second embodiment which is seen from a medal slot side. FIG. 11 is a longitudinally sectional view taken along a plane perpendicular to a guide plate and a plate. FIG. 12 is a perspective view showing a fall-in groove and the plate.

The difference between the pusher game apparatus according to the second embodiment and that according to the first embodiment described above resides in that in the second embodiment jackpot portions 13 are moved horizontally and pockets 40 identical to those described above are provided.

In this apparatus, a microswitch 50 is arranged in a guide portion 14. A medal 12 inserted through an medal slot 1 contacts the microswitch 50 while falling, thereby turning on the microswitch 50. Horizontal movement of the jackpot portions 13 and the microswitch 50 can be realized by an arrangement including a motor 51 mounted to the rear surface of the guide portion 14, a crank mechanism 52 coupled to the motor 51, a support body 53 mounted to the other end of the crank mechanism 52, a guide member 54 for horizontally guiding the support body 53, and a sliding mechanism 55 for reciprocally moving the slidable member 8 at a predetermined interval. A contact segment 50*a* of the switch 50 projects through an opening 14*a* formed in the guide portion 14. An arm member 56 extending from the guide member 54 in a crank manner through the opening 14*a* is fixed to the bottom portion of the guide member 54 in order to conceal the projecting portion of the switch 50. The sliding mechanism 55 is constituted by using a known mechanism, e.g., a rotational crank mechanism. The distal end of the arm member 56 supports the jackpot portion 13 through a transparent front plate 57 arranged in front of the guide portion 14. The front plate 57 is arranged at a predetermined distance from the guide portion 14, and at least an elongated groove 57*a* is formed in the front plate 57 along the opening 14*a*.

While the switch 50 is moved reciprocally in the horizontal direction and a medal 12 is moved downward along the guide portion 14 in this state, when the medal 12 is fortunately brought into contact with the contact segment 50*a* (it seems to the player as if the medal had entered the jackpot portion 13), the medal scattering function operates. More specifically, the switch 50 is closed, and a third control signal is sent from a control means 30 to a medal scattering mechanism driving unit 33. A scattering signal is sent from the medal scattering mechanism driving unit 33 to a motor 23, thereby rotating a circular rotary plate 10 (see FIG. 5). As a result, medals 12 on the circular rotary plate 10 are scattered around. In this case, some of the scattered medals 12 fall in the pocket 40, so that a predetermined number of medals 12 are accumulated. The pocket 40 is usually concealed by, e.g., an ornament plate aside a plate 6, so that its bottom portion (the number of accumulated medals) is not seen. A sensor for detecting the number of medals in the pocket 40 may be provided, so that when the amount of accumulated medals reaches a predetermined value, the accumulated medals 12 may be returned onto the plate 6. The scattering mechanism of this embodiment is identical to that described above, and a detailed description thereof will thus be omitted.

According to this embodiment, since a large number of medals are replenished onto the plate 6 at a predetermined timing for the player, the game becomes exciting and thus encouraging.

Figure 13:
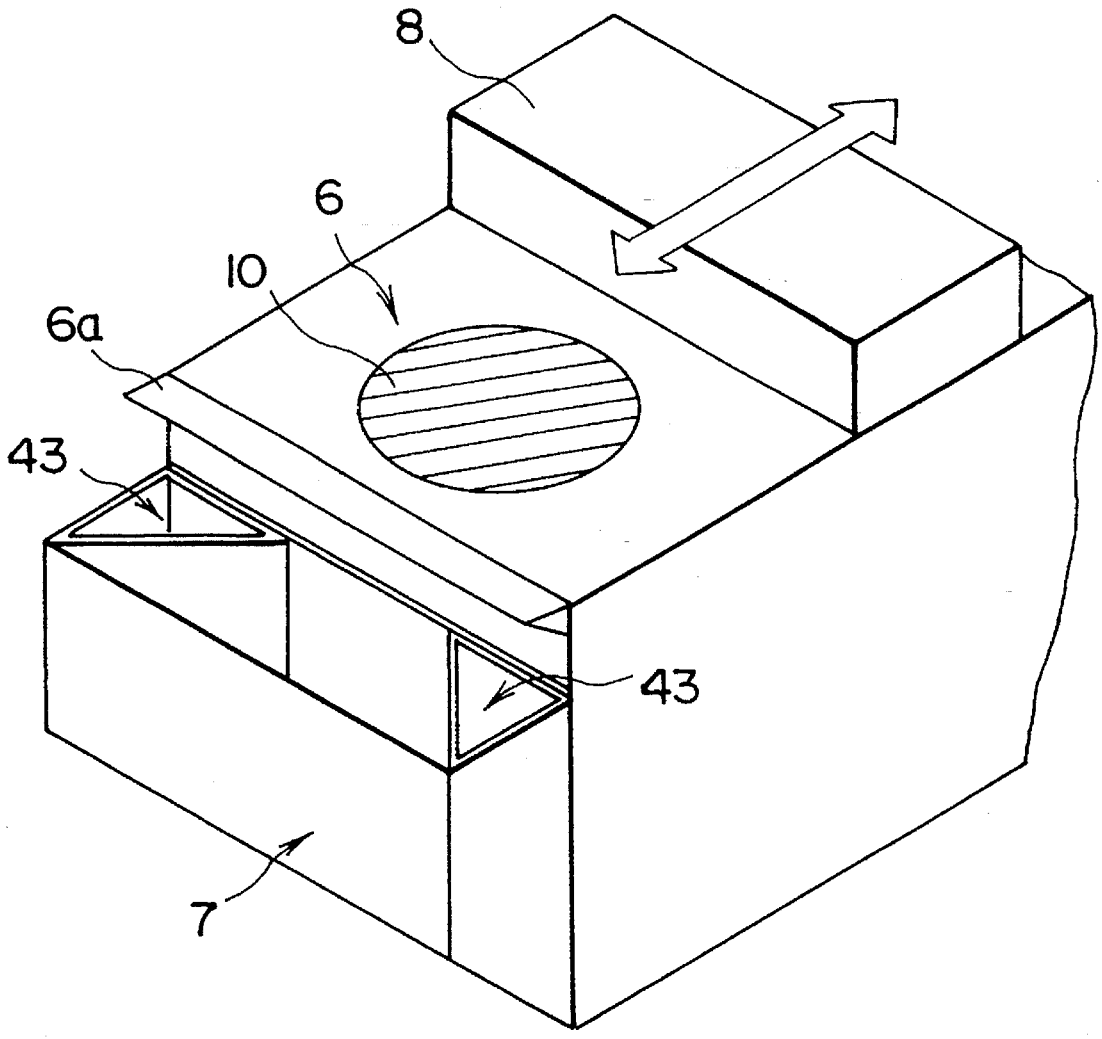
FIG. 13 is a perspective view showing a modification of the fall-in groove that can be applied no the present invention.

A subsidiary mechanism that can be applied to the present invention will be described with reference to FIGS. 13 and 14A and 14B. FIG. 13 is a perspective view showing a modification of the fall-in groove, and FIGS. 14A and 14B include perspective views showing the third medal replenishing mechanism.

Two triangularly partitioned owner's recovery chutes 43 are provided to a fall-in groove 7 shown in FIG. 13. Medals 12 fell in the owner's recovery chutes 43 are accumulated as the "income" of the owner. Some or all of the medals 12 may be accumulated in the medal storing section of the first replenishing mechanism (FIGS. 4A to 4D) or in the medal storing section of the second replenishing mechanism (FIGS. 9A and 9B) described above through the owner's recovery chutes 43.

Figure 14A:
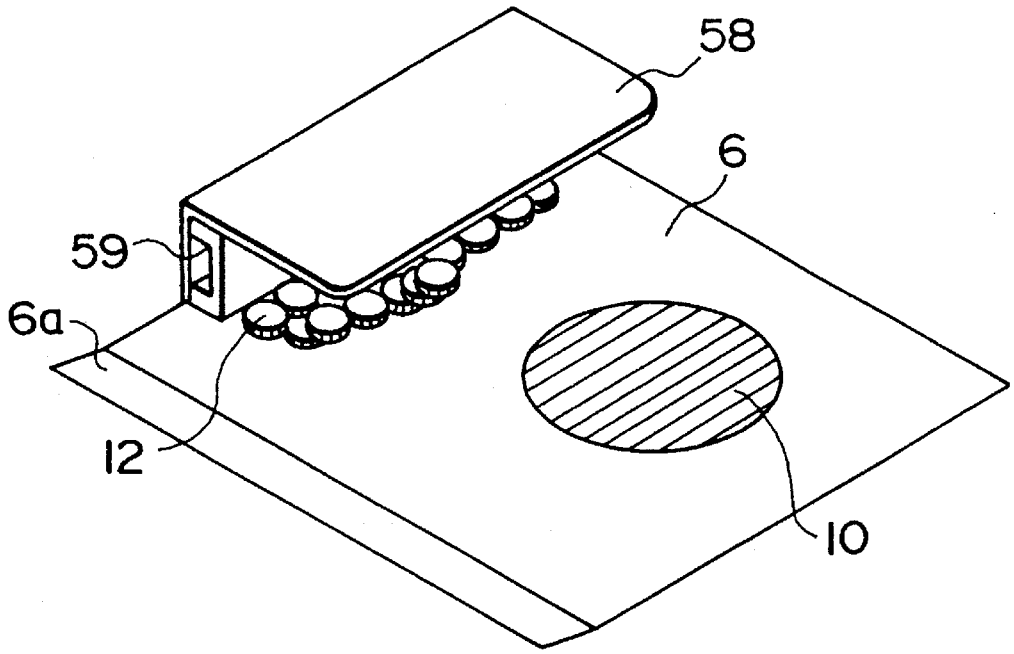
FIGS. 14A and 14B include perspective views showing a modification of a medal replenishing mechanism that can be applied to the present invention.
Figure 14B:
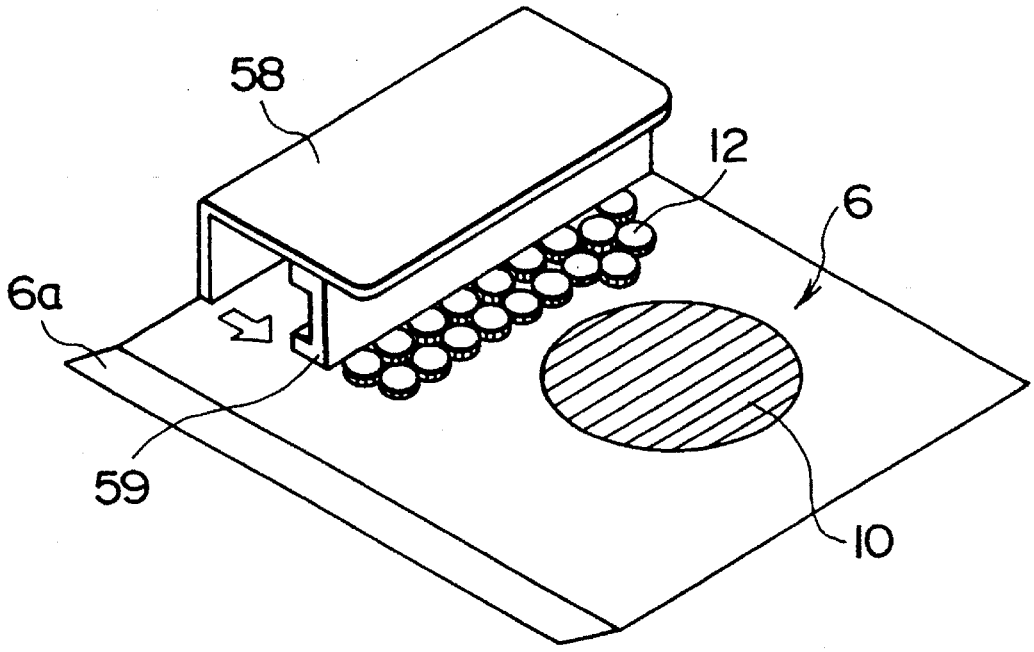

The third medal replenishing mechanism shown in FIGS. 14A and 14B are provided on a side portion of a plate 6. This medal replenishing mechanism is constituted by an ornament plate 58, a medal push-back member 59, and a driving mechanism (not shown). The ornament plate 58 is located above the medal push-back member 59 and covers a predetermined region of the medal push-back member 59 not to be seen. The medal push-back member 59 has a function of moving in a region covered by the ornament plate 58, thereby moving medals 12 accumulated in this region. The driving mechanism is constituted by, e.g., a solenoid, and moves the medal push-back member 59 within the predetermined region described above.

As the game progresses, a predetermined number of medals 12 are stored in the predetermined region covered by the ornament plate 58 (see FIG. 14A). The stored medals 12 are pushed back by the medal push-back member 59 to a region not covered by the ornament plate 58 (see FIG. 14B). As a slidable member 8 continues moving regardless of the operation of the medal replenishing mechanism, the medals 12 on the plate 6 constantly move toward a terminal end portion 6*a* of the plate. Then, when the medal replenishing mechanism operates, the number of medals 12 is increased at once. Thus, a number of medals 12 which cannot be anticipated by the player are fell in a fall-in groove 7, which serve as a kind of bonus to the player.

Hence, the operation of the medal replenishing mechanism is undoubtedly beneficial to the player and improves the entertainment with the game.

The driving method of this medal replenishing mechanism includes a method in which the medal replenishing mechanism is driven when a medal 12 enters a predetermined jackpot portion, a method in which the medal replenishing mechanism is automatically operated when a predetermined number of medals 12 have been inserted in the medal slot, a method in which the medal replenishing mechanism is automatically operated during the duration of the game, and the like.

The embodiments of the present invention have been described so far. The present invention is not limited no the above embodiments. For example, the above embodiments have exemplified game apparatuses that pay off medals to the player directly. However, the game apparatus may employ a method with which the medals are not directly paid but are accumulated as credits, a method with which some % of the number of medals to be paid off to the player are stored at a predetermined location (e.g., in a storing unit), and are paid off at once at a certain timing.

In order to emphasize the presence of the circular rotary plate, the circular rotary plate may be colored differently from the color of the surrounding plated so that the circular rotary plate stands out.

In the above embodiments, "medals" are used in the game. However, any round disk-like objects can be used, e.g., tokens or coins.

In the second embodiment, the jackpot portions 13 are moved horizontally. However, the movement is not limited to horizontal movement, but can be, e.g., vertical movement, rotating movement, non-linear movement, and the like.

The relationship between the jackpot portions 13 and the circular rotary plates 10 has the following aspects that can be applied to the present invention.

The first aspect is a stationary type in which a specific jackpot portion (No. 1, No. 2, or No. 3) 13 which will rotate a specific circular rotary plate 10 by a specific number of revolutions (or for specific seconds) is determined in advance. The second aspect is a variable type in which a specific circular rotary plate 10 which is rotated by a specific number of revolutions (or for specific seconds) every time a medal is detected in a jackpot portion (No. 1, No. 2, or No. 3) 13 is determined randomly or according to a timing. The third aspect is a mixed type in which the rotation time is determined in advance, and a specific circular rotary plate 10 which will be rotated is determined randomly or the like.

An example of the variable type in which rotation of the circular rotary plate is regulated according to a timing will be described. More specifically, an indicator (an indicator of a slot machine, a roulette, or the like), which indicates to the player as to a specific scattering unit which will operate for a specific period of time (number of revolutions or rotation time), is provided to the game apparatus. The indicated contents are updated depending on the lapse of time, the number of inserted medals, the time point at which a medal is detected, or the like. When a medal is detected in a jackpot portion 13, a corresponding scattering unit is operated by a number of revolutions or for a period of time indicated by the indicator. In this case, the number of indicators may be one, or indicators may be provided in units of the jackpot portions (No. 1, No. 2, and No. 3) 13. When indicators are provided in units of the jackpot portions 13, the indicated contents of the respective indicators may be updated simultaneously or one by one. The time point at which the indicated contents are updated may be varied. For example, the indicated contents of the indicator corresponding to the jackpot portion (No. 1) may be updated every predetermined period of time, the indicated contents of the indicator corresponding to the jackpot portion (No. 2) may be updated every time a predetermined number of medals have been inserted, and the indicated contents of the indicator corresponding to the jackpot portion (No. 3) may be updated every time a medal is detected in a jackpot portion 13.

Aspects which are classified in terms of the number of jackpot portions 13 and the number of circular rotary plates 10 and in which the jackpots are changed will be described by way of their practical examples. All these aspects can be applied to the present invention.

1. Single Jackpot Portion:

a) One Jackpot Portion 13 and One Circular Rotary Plate 10

A stationary type with which the circular rotary plate 10 is always rotated for a predetermined period of time (e.g., 3 seconds) when a medal enters the jackpot portion 13, and a variable type with which the rotation time of the circular rotary plate 10 is changed to, e.g., 3, 5, and 10 seconds randomly or at a predetermined timing are possible.

b) One Jackpot Portion 13 and Plurality of (e.g., 3: A, B, and C) Circular Rotary Plates 10

A mixed type with which any one of the circular rotary plates 10 (A, B, and C) is rotated randomly or at a timing for a predetermined period of time when a medal enters the jackpot portion 13, and a variable type with which the rotation time of the circular rotary plate 10 is also changed randomly or at a timing are possible.

2. A Plurality of Jackpot Portions:

a) Three Jackpot Portions 13 (No. 1, No. 2, and No. 3) and One Circular Rotary Plate 10

A fixed type with which the circular rotary plate 10 is rotated for a predetermined period of time when a medal enters any one of the jackpot portions 13 (No. 1, No. 2, and No. 3), a stationary type with which the circular rotary plate 10 is rotated for 3 seconds when a medal enters the jackpot portion 13 (No. 1), 5 seconds when a medal enters the jackpot portion 13 (No. 2), and 10 seconds when a medal enters the jackpot portion 13 (No. 3), and furthermore a variable type with which the circular rotary plate 10 is rotated for a period of time which is changed randomly or at a timing when a medal enters any one of the jackpot portions 13 (No. 1, No. 2, and No. 3) are possible.

b) Three Jackpot Portions 13 (No. 1, No. 2, and No. 3) and Three Circular Rotary Plates 10 (A, B, and C)

A stationary type with which the jackpot portions 13 (No. 1, No. 2, and No. 3) always correspond to the respective circular rotary plates 10 (A, B, and C), for example, the circular rotary plate 10 (A) is rotated for 3 seconds when a medal enters the jackpot portion 13 (No. 1), the circular rotary plate 10 (B) is rotated for 5 seconds when a medal enters the jackpot portion 13 (No. 2), and the circular rotary plate 10 (C) is rotated for 10 seconds when a medal enters the jackpot portion 13 (C), a mixed type with which only this correspondence is changed randomly or at a timing, and furthermore a variable type with which the jackpot portions 13 (No. 1, No. 2, and No. 3), the circular rotary plates 10 (A, B, and C), and the rotation time of the circular rotary plates 10 are changed randomly or at a timing are possible.

In the above embodiments, the circular rotary plates 10 are regulated by the rotation time. However, the circular rotary plates 10 may be regulated by the number of revolutions.

As the present invention has the above arrangement, it can introduce unexpectedness in the gamer thereby further increasing the entertainment with the game.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

The basic Japanese Application No.202087/1994 filed on Aug. 26, 1994 is hereby incorporated by reference.

What is claimed is:

1. A game apparatus characterized in that the apparatus employs a slot for allowing insertion of a medal therethrough, a guide member for guiding the inserted medal downward, a plate arranged substantially horizontally below the guide member, a fall-in groove, provided at at least one end of the plate, for discharging the medal to an outside, a slidable member which moves reciprocally on said plate in a predetermined direction, and a medal which falls through the guide member while the slidable member moves, thereby causing medals on the plate to fall into the fall-in groove directly or indirectly, and further comprises scattering mechanism for scattering medals on said plate.

2. A game apparatus according to claim 1, wherein at least one hole for a scattering region is formed in said plate, and said scattering mechanism has a circular rotary plate rotatably buried in the scattering hole while exposing an upper surface thereof, and a rotating mechanism for rotating said circular rotary plate at a predetermined timing.

3. A game apparatus according to claim 2, wherein said guide member is constituted by at least one jackpot portion, detector for detecting a medal in said jackpot portion, and a first controller for controlling said rotating mechanism on the basis of an input signal sent from said detector and generated by a medal.

4. A game apparatus according to claim 3, wherein said jackpot portion is constituted by a plurality of jackpot portions of different types, said detector further has a type detection function of specifying one jackpot from said plurality of jackpot portions, and said first controller differentiates a rotating state of said circular rotary plate in accordance with the types of said jackpot portions.

5. A game apparatus according to claim 3, further comprising informing means for informing to a player that a medal has entered said jackpot portion.

6. A game apparatus according to claim 3, having at least one circular rotary plate which is rotated for a predetermined period of time or through a predetermined number of revolutions when a medal is detected in said jackpot portion.

7. A game apparatus according to claim 6, wherein the predetermined period of time or the predetermined number of revolutions for or by which said circular rotary plate is rotated is determined in advance.

8. A game apparatus according to claim 6, wherein the predetermined period of time or the predetermined number of revolutions for or by which said circular rotary plate is rotated is changed randomly or at a timing.

9. A game apparatus according to claim 2, wherein said circular rotary plate has an object that influences a scattering state of the medals on said plate.

10. A game apparatus according to claim 2, further comprising an elevating mechanism for vertically moving said rotating mechanism and a replenishing mechanism for replenishing medals onto said circular rotary plate when said rotating mechanism is moved downward.

11. A game apparatus according to claim 10, wherein said first medal replenishing mechanism comprises:

a movement passage formed below said plate to extend in a direction substantially perpendicular to said plate, a first elevating mechanism for vertically moving said scattering mechanism along said movement passage, a medal accumulating portion, formed around said movement passage, for accumulating replenishing medals and dropping and supplying the accumulated medals toward said movement passage, a partition member, disposed around said scattering mechanism, for separating said scattering mechanism from said medal accumulating portion, a second elevating mechanism for moving said partition member along said movement passage, and a second controller for controlling said first and second elevating mechanisms, moving said partition member downward to follow said scattering mechanism in downward movement of said scattering mechanism, and moving said partition member upward earlier than said scattering mechanism in upward movement of said scattering mechanism.

12. A game apparatus according to claim 2, characterized in that said circular rotary plate has an upper surface provided with friction increasing means for increasing a frictional force with respect to the medal.

13. A game apparatus according to claim 2, further having a medal replenishing mechanism for storing medals that are scattered to two sides of said plate by said circular rotary plate and/or a medal which is pushed out directly or indirectly by said slidable member, and for returning stored medals onto said plate or said circular rotary plate.

14. A game apparatus according to claim 1, characterized in that the fall-in groove is provided with a partition plate to store some medals that fall.

15. A game apparatus according to claim 1, further comprising a second medal replenishing mechanism for storing medals scattered by said scattering mechanism and replenishing the medals on said plate at a predetermined timing.

16. A game apparatus according to claim 15, wherein said second medal replenishing mechanism comprises:

a movement passage formed in or around said plate to extend in a direction substantially perpendicular to said plate, an elevating mechanism disposed in said movement passage, an inclined plate disposed in said elevating mechanism and having an inclined surface for supplying medals on and/or above said plate, and a partition member surrounding said inclined plate so as not to drop the medals from said inclined plate toward said elevating mechanism.

17. A game apparatus according to claim 1, further comprising a third medal replenishing mechanism for laterally holding medals, scattered by said scattering mechanism, on said plate to push out the medals to the center on said plate at a predetermined timing.

18. A game apparatus according to claim 17, wherein said third medal replenishing mechanism comprises:

a moving member formed laterally with respect to said plate and movable on said plate in contact therewith, a driving mechanism for reciprocally moving said moving member by a predetermined distance in a direction crossing said plate, and a cover member, disposed above said moving member, for covering a movable area of said moving member.

* * * * *